US005409390A

United States Patent [19]

Yoshida

[11] Patent Number: 5,409,390

[45] Date of Patent: Apr. 25, 1995

[54] CONTACT CONNECTOR

[75] Inventor: Noboru Yoshida, Sawa, Japan

[73] Assignee: Hosiden Corporation, Osaka, Japan

[21] Appl. No.: 93,644

[22] Filed: Jul. 20, 1993

[30] Foreign Application Priority Data

Aug. 5, 1992 [JP] Japan ..... 4-208967

[51] Int. Cl.[6] ..... H01R 27/00

[52] U.S. Cl. ..... 439/218

[58] Field of Search ..... 439/217, 218, 221, 223, 439/224, 682, 650, 651, 652

[56] References Cited

U.S. PATENT DOCUMENTS

| | | | |
|---|---|---|---|
| 2,229,377 | 1/1941 | Friang | 434/218 |
| 3,581,480 | 6/1971 | O'Conner, III | 439/222 |
| 4,217,483 | 8/1980 | Vogel et al. | 439/222 |
| 4,547,689 | 10/1985 | Tsuchimoto et al. | 439/221 |
| 5,007,848 | 4/1991 | Lee | 439/222 |

FOREIGN PATENT DOCUMENTS

| | | | |
|---|---|---|---|
| 9006006 | 5/1990 | European Pat. Off. | 439/218 |

*Primary Examiner*—Gary F. Paumen
*Assistant Examiner*—Hien D. Vu
*Attorney, Agent, or Firm*—Pollock, Vande Sande & Priddy

[57] ABSTRACT

A contact connector is disclosed, which comprises an insulation body defining a contact chamber, a first pin hole, and a second pin hole, the contact chamber being defined inside the insulation body, the first pin hole and the second pin hole being defined on the front surface of the insulation body, the first pin hole being spaced apart from the second pin hole, the second pin hole extending along a first line which passes the first pin hole, the second pin hole having a width at least twice the height thereof, the first pin hole and the second pin hole being connected to the contact chamber, a first contact, disposed in the contact chamber, having at least one elastic contact piece traversing the first pin hole along the first line, and a second contact, disposed in the contact chamber, having at least one elastic contact piece traversing the second pin hole along the first line.

13 Claims, 9 Drawing Sheets

CONTACT CONNECTOR

BACKGROUND OF THE INVENTION

1. Field of the Invention

The present invention relates to a contact connector (corresponding to a conventional socket or a jack) for electrically and mechanically detachably connecting a pin connector (corresponding to a conventional pin plug) which is for example a signal output terminal of, for example, an electret condenser microphone device.

2. Description of the Related Art

When a lead wire which carries a signal is directly soldered to an output terminal of an electret condenser microphone device, the heat produced by soldering is conducted to the microphone device. Thus, the characteristics of the microphone device may be deteriorated. To prevent such a problem, conventionally, a contact connector having two or more contacts therein is used. The contact connector is electrically and mechanically connected to a pin connector of the microphone device. The contact connector is soldered to a printed circuit board.

If several types of pin connectors, each having a different pitch between the contact pins thereof should be used, corresponding contact connectors each having a corresponding pitch between the contacts thereof should be also used. Thus, so far, several types of corresponding contact connectors have been produced. However, since the molds for contact connectors are expensive, the entire production cost of the connectors becomes very high.

SUMMARY OF THE INVENTION

An object of the present invention is to solve the above-described problem and to provide a contact connector to which plural pin connectors having different pin pitches from one another can be connected, and which can be manufactured inexpensively.

In one aspect of the present invention, there is provided a contact connector which comprises an insulation body defining a first hole and an elongated second hole on the front surface of the insulation body for receiving corresponding contact pins of a pin connector, respectively, and having first and second contact chambers inside the insulation body, the first hole being spaced apart from the second hole and defining a fixed receiving position for a contact pin of the pin connector, the elongated second hole extending along a first line which passes the first hole, the elongated second hole having a width that is at least twice the height thereof, the first and second contact chambers being open on the rear surface of said insulation body and being in communication with the first and second holes, respectively, a first contact disposed in the first contact chamber and having at least one elastic contact piece positioned across the width of the first hole, and a second contact disposed in the second contact chamber and having at least one elastic contact piece positioned across the width of the elongated second hole in the direction of the first line.

According to the present invention, the wide pin hole is defined on the front surface of the insulation body together with a narrow pin hole. In addition, a contact having at least one wide elastic contact piece is disposed in the contact chamber which has a width wider than that of the elongated hole and is positioned across the width of the elongated hole. Thus, a plurality of pin connectors having different pitches from one another can be connected to the contact connector. Therefore, a plurality of molds for contact connectors are not required. As a result, the cost of the mold is reduced and thereby the production cost of the contact connector is lowered.

These and other objects, features and advantages of the present invention will become more apparent in light of the following detailed description of a best mode embodiment thereof, as illustrated in the accompanying drawings.

DESCRIPTION OF THE PREFERRED EMBODIMENTS

Figure 1A:
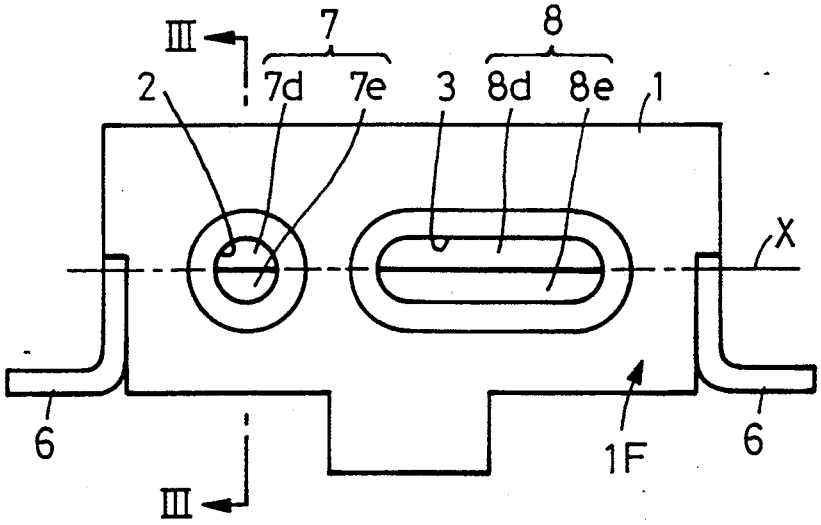
FIG. 1A is a front view showing the construction of a contact connector according to a first embodiment of the present invention.
Figure 2A:
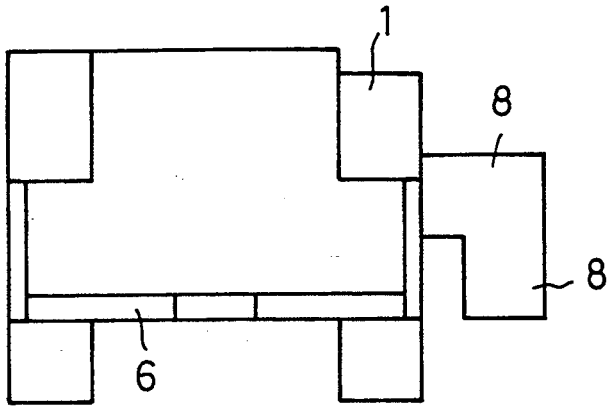
FIG. 2A is a right side view of the contact connector of FIG. 1A.
Figure 2B:
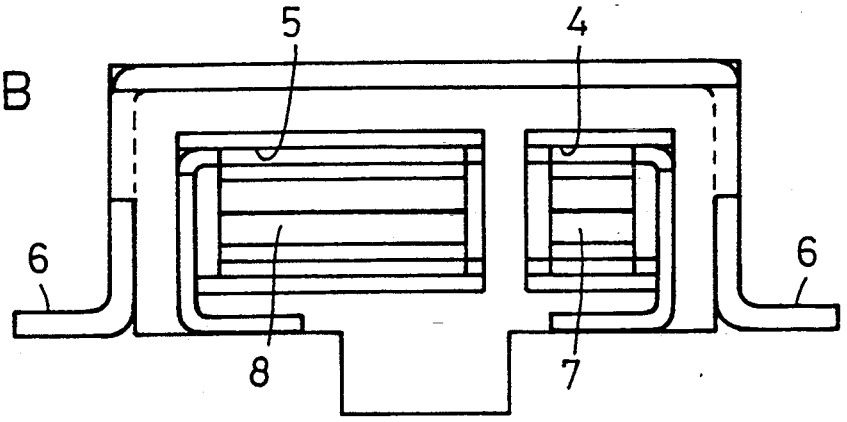
FIG. 2B is a rear view of the contact connector of FIG. 1A.
Figure 3:
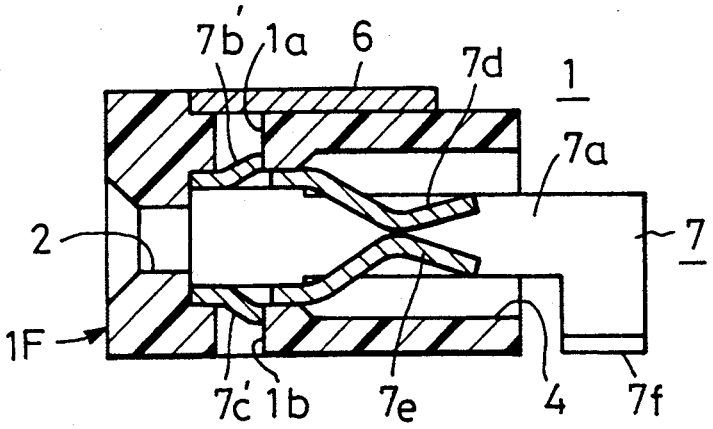
FIG. 3 is a sectional view taken along line III—III of FIG. 1A.
Figure 6:
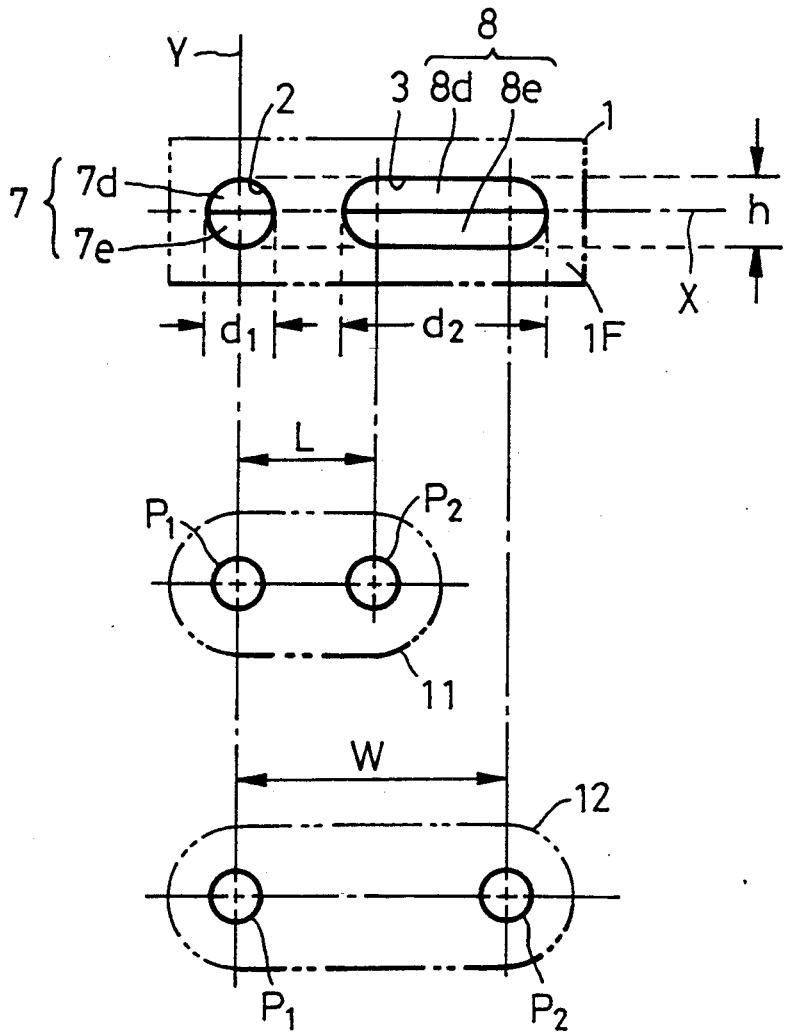
FIG. 6 is a schematic diagram for explaining the relation (connections) of the contact connector according to the first embodiment and pin connectors.

Next, with reference to the accompanying drawings, contact connectors according to embodiments of the present invention will be described. FIG. 1A shows a body 1 of a contact connector according to a first embodiment of the present invention. As shown in FIG. 1A, a first hole 2 and an elongated second hole 3 for receiving corresponding contact pins of a pin connector (not shown) are defined on a front surface 1F of the body 1. The first hole 2 has a width (in the direction of line X) narrower than that of the second hole 3, and the first hole 2 will be referred to hereinafter as the "narrow pin hole" and the second hole 3 as the "wide pin hole". The body 1 is made of an insulation material such as synthetic resin. As shown in FIG. 2B, chambers 4 and 5 for receiving first and second contacts 7 and 8 of the contact connector are defined in the body 1. The chambers 4 and 5 are open on the rear surface of the body 1 and extend close to the front surface 1F of the body 1, respectively, as shown in FIG. 3 which is a sectional view taken along line III—III of FIG. 1A. The chambers 4 and 5 are in communication with the narrow pin hole 2 and the wide pin hole 3, respectively. In this embodiment, the narrow pin hole 2 has the shape of a circle, whereas the wide pin hole 3 has the shape of a long circle with the opposite longer sides thereof parallel to one another. In this embodiment and other embodiments which will be described later, it should be noted that the narrow pin hole may have the shape of an almost square, an almost regular hexagon, or another almost regular polygon. On the other hand, the wide pin hole 3 may have the shape of a long rectangle. In this embodiment, the width d1 of the narrow pin hole 2 is nearly equal to the height h thereof. As shown in FIG. 6, the width d2 of the wide pin hole 3 is at least twice as larger as the height h thereof. A fixing metal member 6 is disposed along the upper surface and left and right side surfaces of the body 1.

As shown in FIG. 2B, the first contact 7 housed in the chamber 4 has a width narrower than that of the second contact 8 housed in the chamber 5, and hereinafter the first contact is referred to as the "narrow contact" and the second contact as the "wide contact". These contacts 7 and 8 are inserted from the rear surface of the body 1.

Figure 4A:
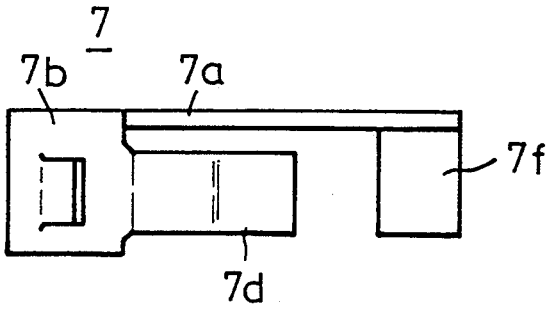
FIG. 4A is a top view of a first contact according to the first embodiment.
Figure 4B:
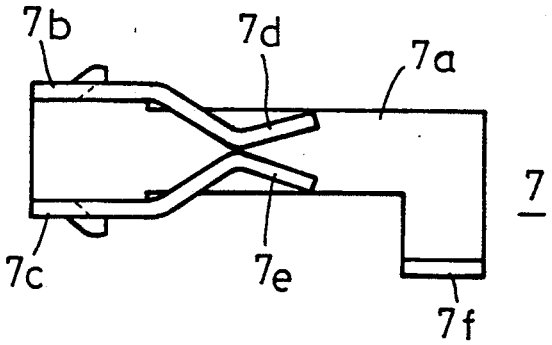
FIG. 4B is a side view of the first contact of FIG. 4A.

FIGS. 4A and 4B are a plan view and a side view of the narrow contact 7. The left side of these figures represents the front of the body 1. Thus, the right side of these figures represents the rear of the body 1. The narrow contact 7 comprises a rectangular side plate portion *7a*, an upper plate portion *7b*, and a lower plate portion *7c*. The upper and lower plate portions *7b* and *7c* have respective contact pieces of narrow width extended backward from the rear edges thereof. The side plate portion *7a* extends in the direction of the depth (from the front to the rear) of the body 1. The upper plate portion *7b* and the lower plate portion *7c* extend from the upper and lower edges of the front end of the side plate *7a* in a horizontal direction (in a direction perpendicular to the plane of the side plate portion *7a*), respectively. The upper plate portion *7b* is opposed to the lower plate portion *7c*. Intermediate portions of the narrow contact pieces *7d* and *7e* are bent so that they elastically contact with each other. The width of each of the narrow contact pieces *7d* and *7e* is larger than the width d1 of the narrow pin hole 2 and the contact pieces *7d* and *7e* are positioned across the narrow pin hole 2 in the direction of the width thereof. A terminal piece *7f* protrudes from the rear edge of the side plate portion *7a*. In other embodiments which will be described later, each narrow contact has similar contact pieces.

Figure 5A:
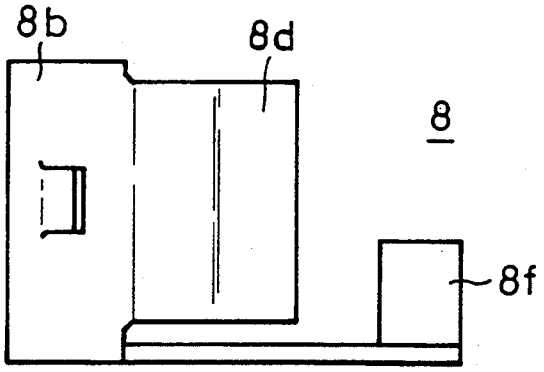
FIG. 5A is a top view of a second contact according to the first embodiment.
Figure 5B:
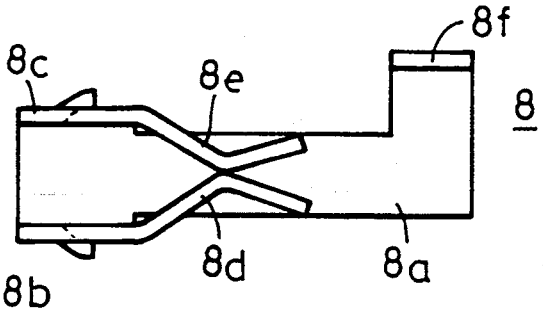
FIG. 5B is a side view of the second contact of FIG. 5A.

FIGS. 5A and 5B are a plan view and a side view of the wide contact 8. The width of each of the wide contact pieces *8d* and *8e* of the wide contact 8 is larger than the width d2 of the wide pin hole 3. The wide contact pieces *8d* and *8e* are positioned across the wide pin hole 3 in the direction of the width thereof, that is, line X shown in FIG. 1A. The construction of the wide contact 8 is symmetrical to that of the narrow contact 7 with respect to a center line therebetween except that the widths thereof are different from each other. In the wide contact 8, the portions similar to the narrow contact 7 are denoted by reference numeral 8x instead of reference numeral 7x and the description thereof is omitted. In other embodiments which will be described later, the corresponding wide contact has similar wide contact pieces.

FIG. 3 is a sectional view showing a state where the narrow contact 7 is housed in the chamber 4 of the body 1. In this state, cut portions *7b'* and *7c'* defined on the upper plate portion *7b* and the lower plate portion *7c* of the narrow contact 7 fit to through-holes 1*a* and 1*b* of the body 1 so as to prevent the narrow contact 7 from dropping. Since the wide contact 8 is housed in the chamber 5 in the same way as the narrow contact 7, this illustration is omitted.

Figure 1B:
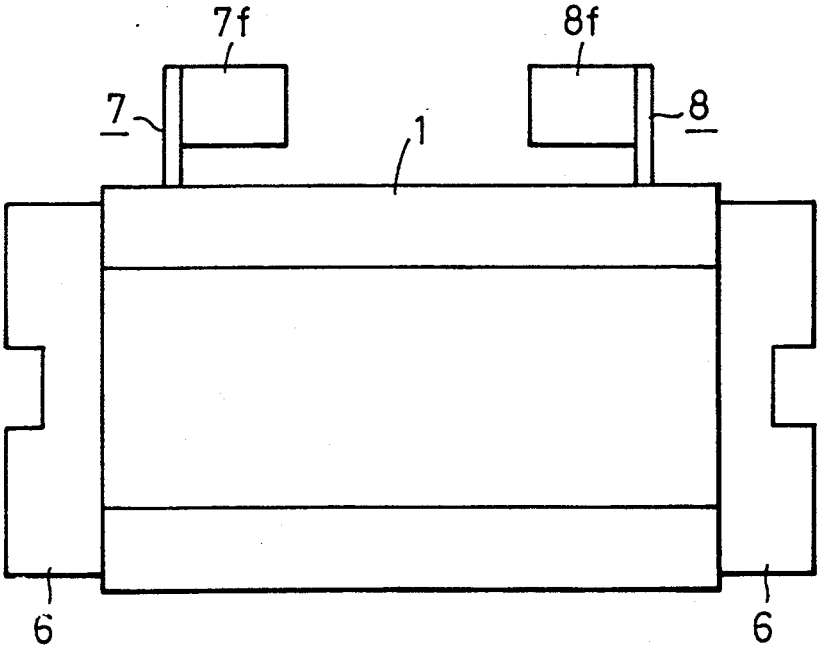
FIG. 1B is a top view of the contact connector of FIG. 1A.

FIG. 6 is a schematic diagram showing connections of pin connectors 11 and 12 and the contact connector (namely, the body 1) shown in FIGS. 1A and 1B. The pin connectors 11 and 12 are output terminals for use with for example an electret condenser microphone device (not shown). In FIG. 6, each of the connectors 11 and 12 has pins P1 and P2 with different pitches. It is assumed that the pin connector 11 has a minimum pitch L, and the pin connector 12 has a maximum pitch W. When the pitches of the pins P1 and P2 of the pin connectors 11 and 12 are L and W, respectively, as shown in FIG. 6, the wide contact 8 of the contact connector according to the present invention is selected to have its width extending from a position spaced apart from the narrow pin hole 2 by nearly L to a position spaced apart from the narrow pin hole 2 by nearly W, and the wide contact 8 is positioned across the width of the wide pin hole 3. In FIG. 6, a line perpendicular to the line X is denoted by Y.

When the pins P1 and P2 of the pin connector 11 are inserted into the contact connector according to the present invention through the corresponding pin holes 2 and 3 defined on the front surface thereof, the pins P1 and P2 cause the narrow contact pieces *7d* and *7e* and the wide contact pieces *8d* and *8e* to be elastically displaced in the direction of the line Y (namely, the vertical direction in FIGS. 4B and 5B). Thus, the pins P1 and P2 are elastically gripped between the narrow contact pieces *7d* and *7e* and between the wide contact pieces *8d* and *8e*, respectively. Thereby, the pins P1 and P2 are electrically connected to the narrow contact pieces *7d* and *7e* and the wide contact pieces *8d* and *8e*, respectively. In this embodiment, as shown in FIG. 6, the pin P2 of connector 11 comes in contact with the left end of the wide contact 8. When the pins P1 and P2 of the pin connector 12 are inserted into the contact connector, the pin P2 becomes in contact with the right end of the wide contact 8 (as shown in FIG. 8).

FIGS. 7 to 10 show second to fifth embodiments of the present invention. In these embodiments, for the sake of simplicity, the portions corresponding to the pin holes 2 and 3 which are defined on the front surface 1F of the body 1, part of contacts 7 and 8 (namely, the contact pieces *7d*, *7e*, *8d*, and *8e*) which are each contacted through the pin holes 2 and 3, and so forth are denoted by the same reference numerals and the description thereof is omitted.

Figure 7:
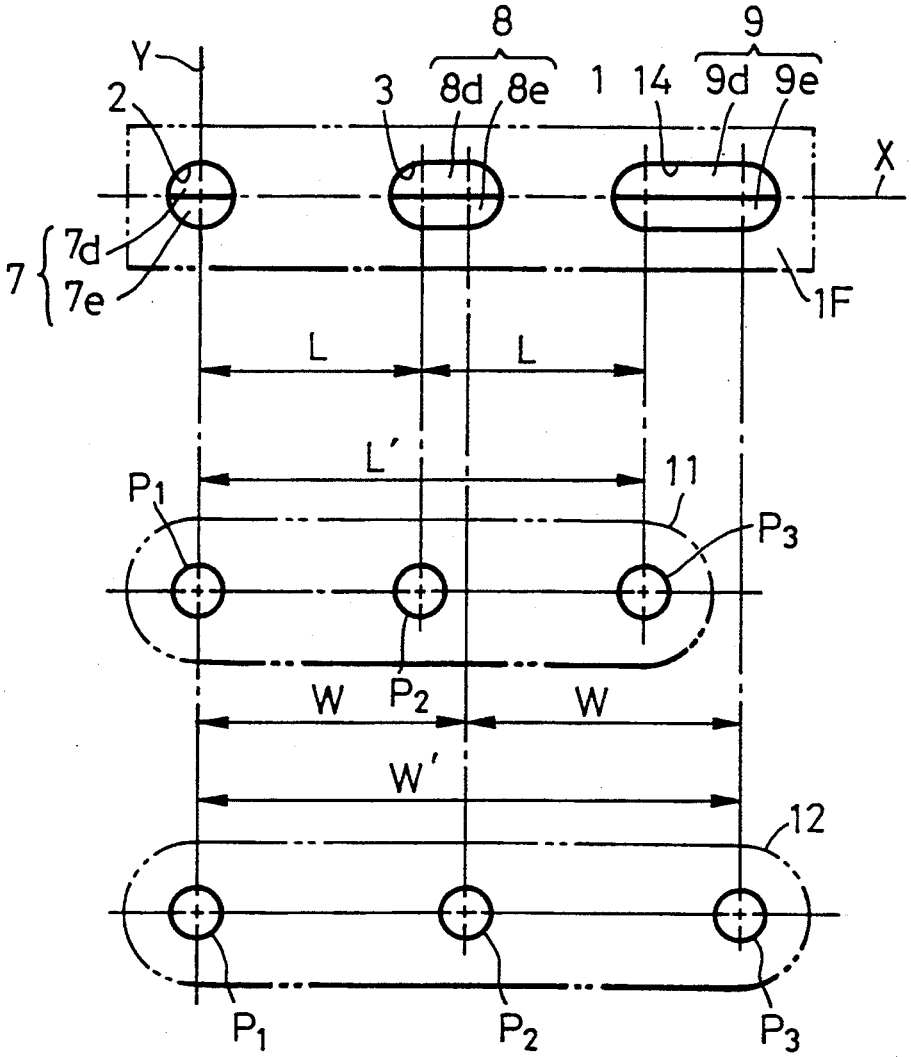
FIG. 7 is a schematic diagram for explaining the relation of FIG. 6 according to a second embodiment of the present invention.

FIG. 7 shows a second embodiment of the present invention. In this embodiment, the pin connectors 11 and 12 shown in FIG. 6 each have a pin P3 which is disposed on the same plane of the pins P1 and P2. The pitch of the adjacent pins of the pin connector 11 is L, whereas the pitch of the adjacent pins of the pin connector 12 is W. In addition, the contact connector according to the present invention has a third pin hole 14 and a third contact 9 which correspond to the pin P3. The wide pin holes 3 and 14 are defined on the front surface 1F of the body 1. The wide pin holes 3 and 14 extend along the line X which passes the narrow pin hole 2. The third contact 9 is a wide contact. The third contact 9 is inserted from the rear of the body 1 into a third chamber (not shown) which has the same construction as those of the chambers 4 and 5 shown in FIGS. 2B and 3. The third pin hole 14 is connected to the third chamber. The relation between the wide pin hole 3 and the wide contact 8 is the same as that shown in FIG. 6. In the contact connector 11, the pitch between the pins P1 and P3 is L'. In the contact connector 12, the pitch between the pins P1 and P2 is W'. In this embodiment, L' is selected to be twice as large as L, W' is selected to be twice as large as W, and the third contact 9 is positioned as shown in FIG. 7. Thus, the contact connector can be used for the pin connectors 11 and 12.

Figure 8:
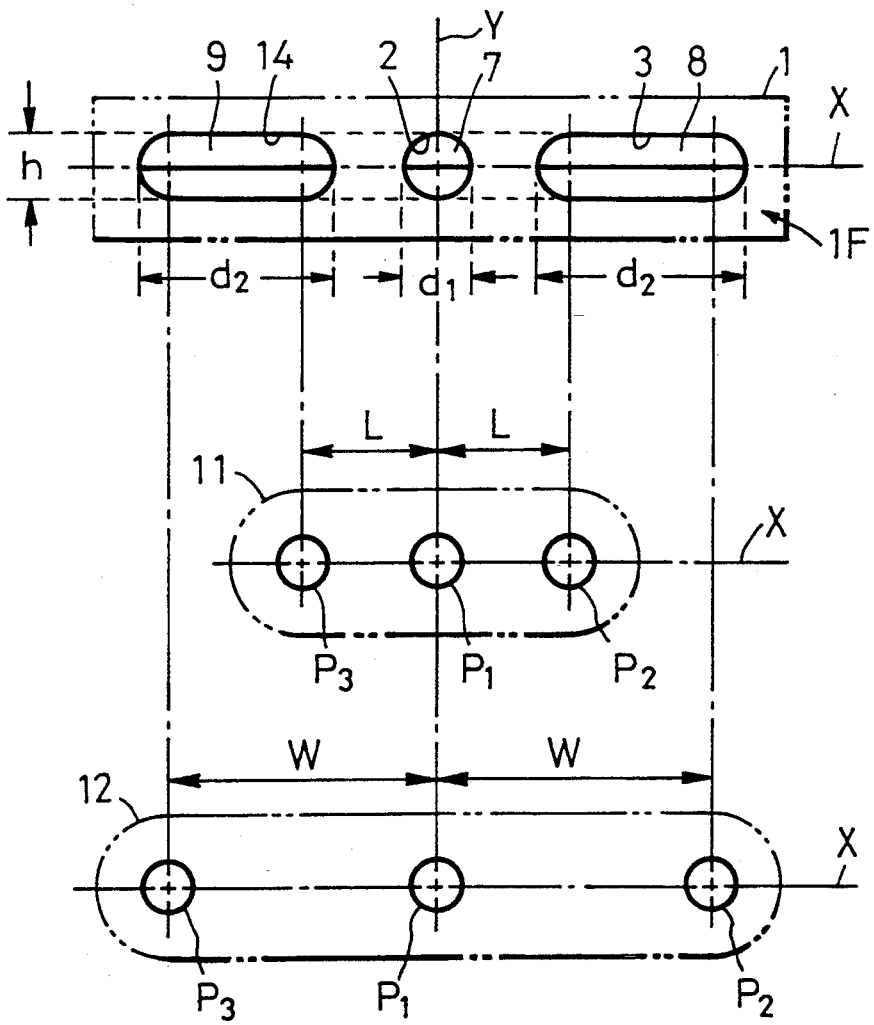
FIG. 8 is a schematic diagram for explaining the relation of FIG. 6 according to a third embodiment of the present invention.

FIG. 8 shows a third embodiment of the present invention. In this embodiment, a wide pin hole 14 is defined on the left of the narrow pin hole 2 shown in FIG. 6 so that the wide pin hole 14 and the wide pin hole 3 are symmetrically disposed with respect to the narrow pin hole 2. The height h and the width d2 of the wide pin hole 14 are almost the same as those of the wide pin hole 3. In other words, the wide pin hole 14, the narrow pin hole 2, and the wide pin hole 3 are defined in line along the line X. It should be noted that when the pin connectors 11 and 12 do not have the center pin P1, the narrow pin hole 2 and the corresponding narrow contact 7 of the contact connector shown in FIG. 8 may be omitted.

Figure 9:
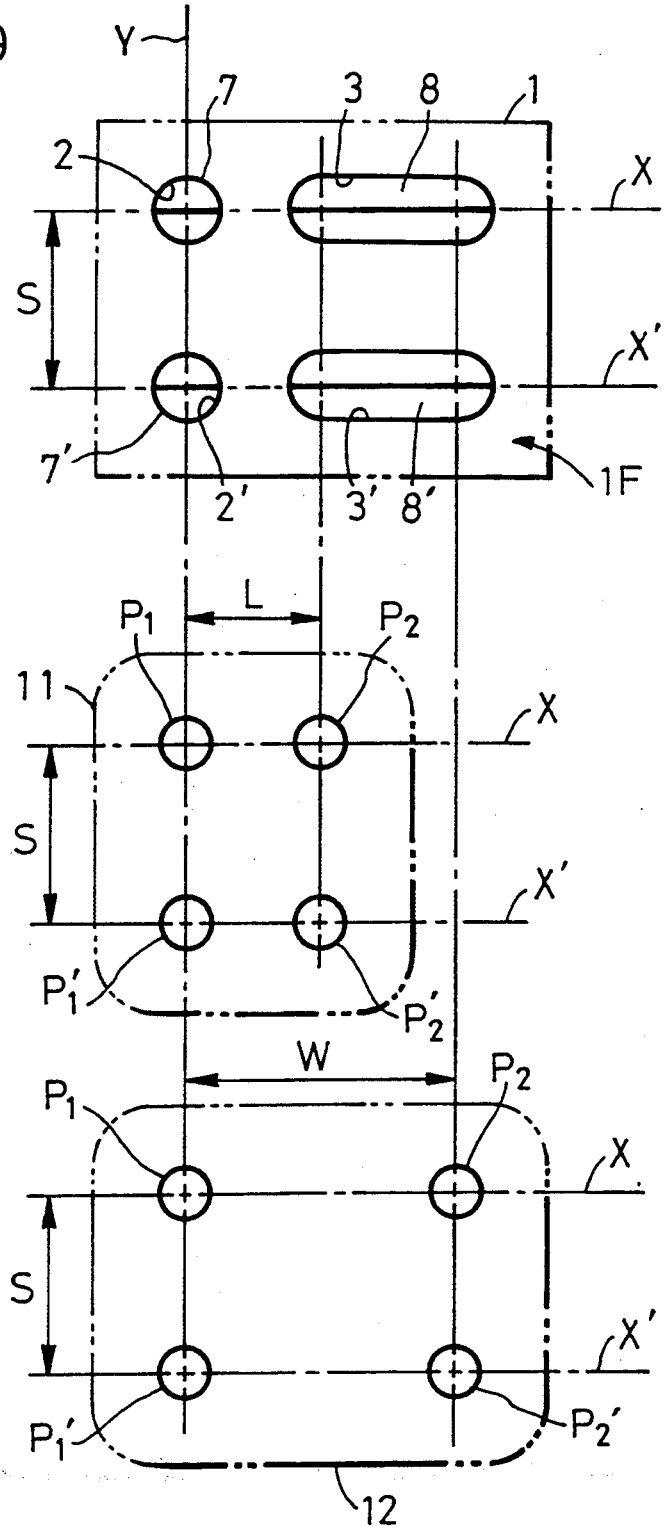
FIG. 9 is a schematic diagram for explaining the relation of FIG. 6 according to a fourth embodiment of the present invention.

FIG. 9 shows a fourth embodiment of the present invention. In this embodiment, another set of pin holes 2' and 3' are defined along a line X' which is in parallel with the line X on the front surface of the body 1 shown in FIG. 6. Accordingly, a narrow contact 7' and a wide contact 8' are disposed below the narrow contact 7 and the wide contact 8 shown in FIG. 6. Thus, pin connectors 11 and 12 each having pins P1' and P2' can be used for the contact connector according to the present invention. In this embodiment, the distance S between the lines X and X' in the body 1, and the pin connectors 11 and 12 is the same. In this embodiment, when the connectors 11 and 12 do not have one of the pins P1, P2, P1' and P2' the corresponding one of the pin holes 2, 3, 2', and 3' and the corresponding one of the contacts 7, 8, 7' and 8' may be omitted.

Figure 10:
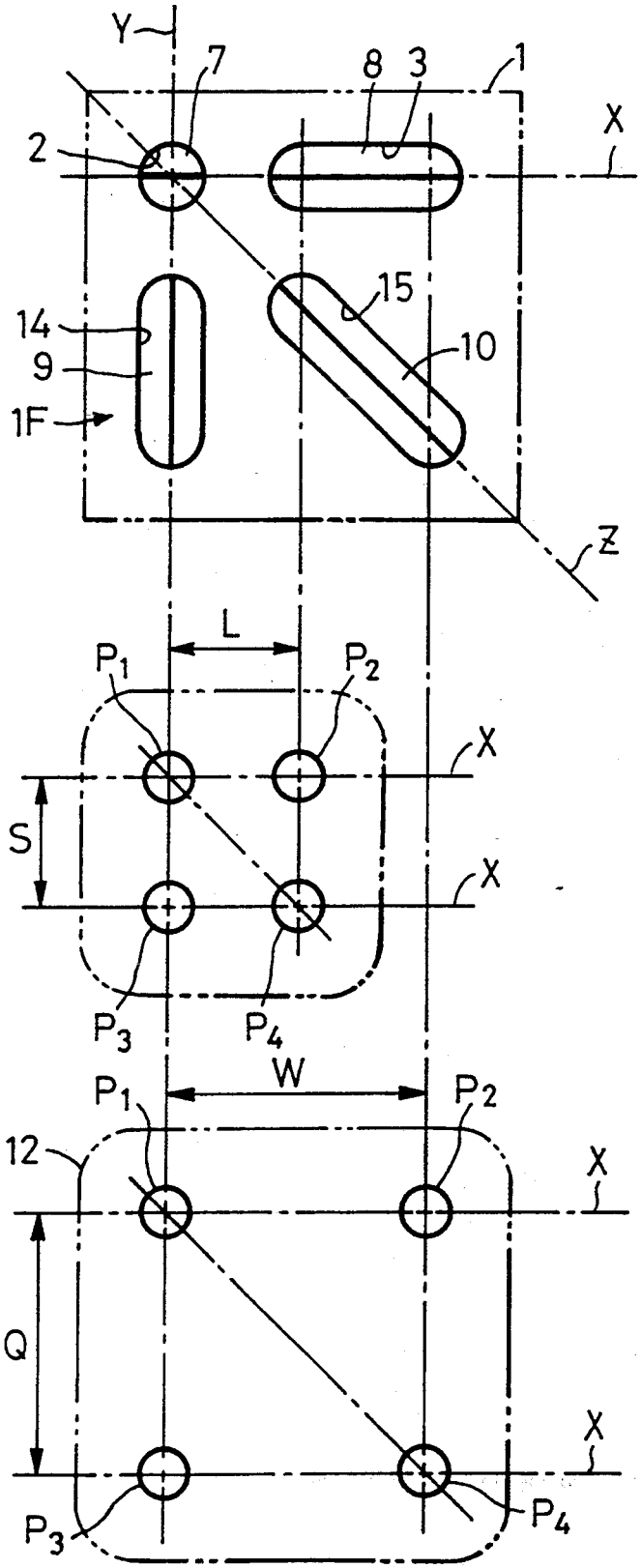
FIG. 10 is a schematic diagram for explaining the relation of FIG. 6 according to a fifth embodiment of the present invention.

FIG. 10 shows a fifth embodiment of the present invention. In this embodiment, a wide pin hole 14 is defined along a line Y which is perpendicular to the line X passing the narrow pin hole 2 shown in FIG. 6. In addition, a wide pin hole 15 is defined along a line Z which passes the narrow pin hole 2 and which is an equidistant line between the line X and the line Y. Moreover, the body 1 has wide contacts 9 and 10 corresponding to the wide pin holes 14 and 15, respectively. In this embodiment, the line Z has an angle of 45° relative to each of the lines X and Y. The directions of the wide contacts 8, 9, and 10 accord with the directions X, Y, and Z, respectively. Pin connectors 11 and 12 which fit to the contact connector each have a pin P3 and a pin P4 as well as the pins P1 and P2. The pins P3 and P4 are disposed on the line Y and the line Z, respectively. These four pins P1, P2, P3, and P4 are disposed at positions which forms a quadrilateral. In the pin connector 11, the pitch in the direction of the line Y is S. In the pin connector 12, the pitch in the direction of the line Y is Q. Now assume that in the wide pin holes 3, 14, and 15, the side close to the narrow pin hole 2 and the other side far therefrom are referred to as the close side and the far side, respectively. The positions of the narrow pin hole 2 and each close side of the wide pin holes 3, 14, and 15 nearly accord with four angles of a first quadrilateral. The positions of the narrow pin hole 2 and each far side of the wide pin holes 3, 14, and 15 nearly accord with four angles of a second quadrilateral. Thus, the pin connectors 11 and 12 shown in FIG. 10 can be used for the contact connector (namely, the body 1) according to the present invention. In this embodiment, when the pin connectors 11 and 12 do not have one of the pins P1, P2, P3, and P4, the corresponding one of the pin holes 2, 3, 14, and 15 and the corresponding one of the contacts 7, 8, 9, and 10 can be omitted. Moreover, in this embodiment, it should be noted that S may be not equal to L and that Q may be not equal to W. In this case, the angle made by the line Z and the line X becomes other than 45°.

Figure 11:
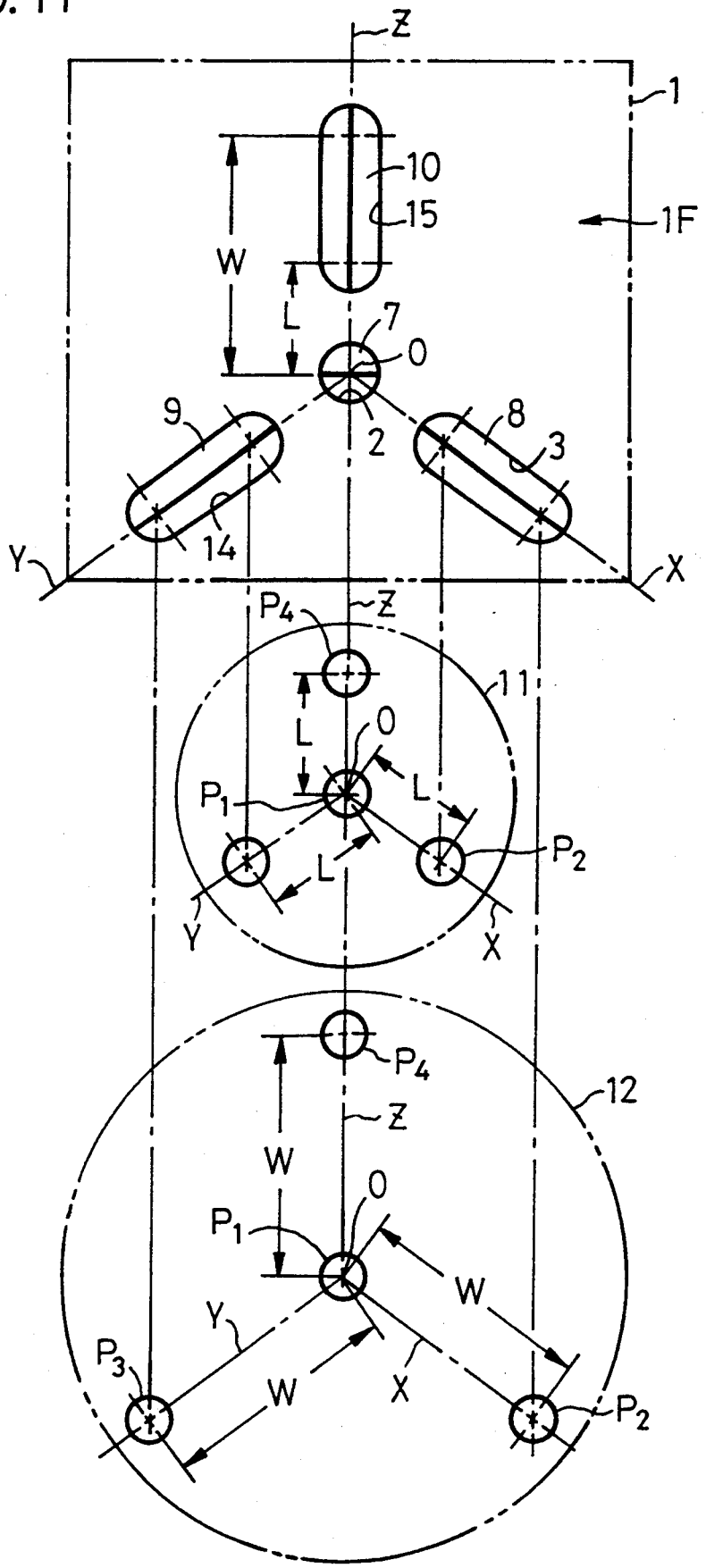
FIG. 11 is a schematic diagram showing a sixth embodiment, where each contact is radially disposed around origin O.

FIG. 11 shows a sixth embodiment of the present invention. In this embodiment, pin connectors 11 and 12 each have three pins P2, P3, and P4. These pins P2, P3, and P4 are disposed at equidistant positions on lines X, Y, and Z which radially extend from the origin P of each of the pin connectors 11 and 12. In the pin connector 11, the distance between the origin O and each of the positions of the pins P2, P3, and P4 is L. In the pin connector 12, the distance between the origin O and each of the positions of the pins P2, P3, and P4 is W. The angle made by any two of the lines X, Y, and Z is 120°.

A narrow pin hole 2 is defined at origin O which is nearly at the center position of the front surface of the body 1 of the contact connector according to the present invention. Wide pin holes 3, 14, and 15 are defined along lines X, Y, and Z which radially extend from the origin O. The distance between the origin O and the close side of each of the wide pin holes 3, 14, and 15 is nearly L. The distance between the origin O and the far side of each of the wide pin holes 3, 14, and 15 is nearly W. First to fourth contacts 7, 8, 9, and 10 corresponding to the pin holes 2, 3, 14, and 15 are disposed in the body 1. Thus, the pin connectors 11 and 12 can be used for the contact connector according to the present invention. In this embodiment, when the connectors 11 and 12 is not have the center pin P1, the corresponding narrow pin hole 2 and the corresponding narrow contact 7 may be omitted.

In the above embodiments, the case where the pitches are L and W was described. However, it should be noted that a pin connector which has pins whose pitches are between L and W can fit to the contact connector according to the present invention. Moreover, in the above description, only an electret condenser microphone was described. However, the present invention is not limited to it.

As described above, according to the contact connector of the present invention, almost all pin connectors may fit thereto. Thus, a common metal mold can be used, thereby reducing the production cost of connectors.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. A contact connector for connection with a pin connector having a plurality of contact pins, comprising:

an insulation body defining a first hole and an elongated second hole on the front surface of said insulation body for receiving corresponding contact pins of the pin connector, respectively, and first and second contact chambers inside said insulation body, said first hole being spaced from said elongated second hole and defining a fixed single receiving position for a contact pin of the pin connector, said elongated second hole extending along a first line which passes said first hole, and said elongated second hole having a width that is at least twice the height thereof, said first and second contact chambers being open on the rear surface of said insulation body and being in communication with said first and second holes, respectively:

a first contact disposed in said first contact chamber and having at least one elastic contact piece positioned across the width of said first hole; and a second contact disposed in said second contact chamber and having at least one elastic contact piece positioned across the width of said elongated second hole in the direction of said first line so that it can contact a corresponding pin contact of any one of several different pin connectors respectively having different pin pitches from one another, said different pin pitches being within the range of a pitch corresponding to about a distance between said first hole and one side, near said first hole, of said elongated second hole to a pitch corresponding to about a distance between said first hole and another side, opposite said one side and remote from said first hole, of said elongated second hole.

2. The contact connector as set forth in claim 1, wherein said first hole has nearly the same height and width as the height of said elongated second hole.

3. The contact connector as set forth in claim 2, wherein said insulation body further defines a third pin hole, said third pin hole being defined on the front surface of said insulation body, said third pin hole being spaced apart from said second pin hole, said third pin hole extending along said first line which passes said first pin hole and said second pin hole in the opposite direction of said first pin hole, said third pin hole having a width larger than the width of said second pin hole, said third pin hole having the same height as said second pin hole, said third pin hole being connected to said chamber, and wherein said contact connector further comprises a third contact having at least one elastic contact piece traversing said third pin hole along said first line.

4. The contact connector as set forth in claim 2, wherein said insulation body further defines a third pin hole being symmetrical to said second pin hole with respect to said first pin hole, the width of said third pin hole being larger than the width of said first pin hole, said third pin hole being connected to said contact chamber, and wherein said contact connector further comprises a third contact having at least one elastic contact piece traversing said third pin hole along said first line.

5. The contact connector as set forth in claim 2, wherein said insulation body further defines a third pin hole defined along a second line which is in parallel with said first line, said third pin hole having the same width and height as those of said second pin hole, said third pin hole being connected to said contact chamber, and wherein said contact connector further comprises a third contact having at least one elastic contact piece traversing said third pin hole along said second line.

6. The contact connector as set forth in claim 5, wherein said insulation body further defines a fourth pin hole defined at a position where a third line which passes said first pin hole orthogonally intersects with said second line, said fourth pin hole having the same width and height as those of said first pin hole, said fourth pin hole being connected to said contact chamber, and wherein said contact connector further comprises a fourth contact having at least one elastic contact piece traversing said third pin hole along said third line.

7. The contact connector as set forth in claim 2, wherein said insulation body further defines a third pin hole extending along a second line which passes said first pin hole and intersects with said first line with a predetermined angle, said third pin hole having the same height as that of said first pin hole, said third pin hole having a width which is at least twice as large as that of said first pin hole, said third pin hole being connected to said contact container, and wherein said contact connector further comprises a third contact having at least one elastic contact piece traversing said second line along said second line.

8. The contact connector as set forth in claim 7, wherein said angle is 90° or less.

9. The contact connector as set forth in claim 7, wherein said angle is 90°.

10. The contact connector as set forth in claim 7, wherein said angle is 120°.

11. The contact connector as set forth in claim 9, wherein said insulation body further defines a fourth pin hole extending along a third line which passes said first pin hole and which is an equidistant line between said first and second lines, said fourth pin hole having the same height as that of said first pin hole, said fourth pin hole having a width which is at least twice as large as that of said first pin hole, said fourth pin hole being connected to said contact chamber, and wherein said contact connector further comprises a fourth contact having at least one elastic contact piece traversing said fourth pin hole along said third line.

12. The contact connector as set forth in claim 10, wherein said insulation body further defines a fourth pin hole extending along a third line with an angle of 180° against each of said first and second lines, said fourth pin hole having the same height as that of said first pin hole, said fourth pin hole having a width which is at least twice as large as that of said first pin hole, said fourth pin hole being connected to said contact chamber, and wherein said contact connector further comprises a fourth contact having at least one elastic contact piece traversing said fourth pin hole along said third line.

13. The contact connector as set forth in claim 11, wherein said first pin hole and a first end of each of said second, third and fourth pin holes are positioned at four angles of a first quadrilateral, and wherein said first pin hole and a second end of each of said second, third and fourth pin holes are positioned at four angles of a second quadrilateral.

* * * * *